US005268955A

United States Patent [19]

Burke et al.

[11] Patent Number: 5,268,955

[45] Date of Patent: Dec. 7, 1993

[54] RING TUBE X-RAY SOURCE

[75] Inventors: James E. Burke, Villa Park; Lester Miller, Forest Park, both of Ill.

[73] Assignee: Picker International, Inc., Highland Hts., Ohio

[21] Appl. No.: 862,805

[22] Filed: Apr. 8, 1992

Related U.S. Application Data

[63] Continuation-in-part of Ser. No. 817,294, Jan. 6, 1992, and a continuation-in-part of Ser. No. 817,295, Jan. 6, 1992, Pat. No. 5,200,985, and a continuation-in-part of Ser. No. 819,296, Jan. 6, 1992.

[51] Int. Cl.[5] ..... H01J 35/04

[52] U.S. Cl. ..... 378/135; 378/101; 378/132

[58] Field of Search ..... 378/135, 101, 4, 10, 378/11, 12, 15, 121, 130, 131, 132, 134, 137, 141, 147, 136

[56] References Cited

U.S. PATENT DOCUMENTS

| | | | |
|---|---|---|---|
| 4,048,496 | 9/1977 | Albert | 250/272 |
| 4,122,346 | 10/1978 | Enge | 250/398 |
| 4,135,095 | 1/1979 | Watanabe | 250/445 |
| 4,203,036 | 5/1980 | Tschunt | 250/445 |
| 4,274,005 | 6/1981 | Yamamura et al. | 378/10 |
| 4,300,051 | 11/1981 | Little | 250/445 |
| 4,368,535 | 1/1983 | Baumann | 378/15 |
| 4,417,171 | 11/1983 | Schmitmann | 313/16 |
| 4,821,305 | 4/1989 | Anderson | 378/136 |
| 4,866,745 | 9/1989 | Akai | 378/9 |
| 4,942,597 | 7/1990 | Van Acker et al. | 378/197 |
| 5,046,186 | 9/1991 | Rohmfeld | 378/125 |
| 5,067,143 | 11/1991 | Watanabe et al. | 378/110 |
| 5,125,012 | 6/1992 | Schittenhelm | 378/10 |
| 5,179,583 | 1/1993 | Oikawa | 378/10 |
| 5,191,600 | 3/1993 | Vincent et al. | 378/10 |

FOREIGN PATENT DOCUMENTS

| | | | |
|---|---|---|---|
| 377534A1 | 7/1990 | European Pat. Off. . | |
| 456114A | 4/1991 | European Pat. Off. . | |
| 4551177A | 4/1991 | European Pat. Off. . | |
| 455177A2 | 11/1991 | European Pat. Off. . | |
| 456114A3 | 11/1991 | European Pat. Off. . | |
| 2729353 | 1/1979 | Fed. Rep. of Germany | 378/10 |
| 2328280 | 5/1977 | France . | |
| 3226950A | 1/1990 | Japan . | |
| 1635090A | 4/1990 | U.S.S.R. . | |

OTHER PUBLICATIONS

Brushless DC Motors and Servo Amplifiers ©1988 Inland Motor, Kollmorgen Corporation.

A New Design For High Speed Computerized Tomography, Maydan, et al. IEEE Transactions on Nuclear Science, vol. NS-26, No. 2, Apr. 1979.

*Primary Examiner*—David P. Porta

*Attorney, Agent, or Firm*—Fay, Sharpe, Beall, Fagan, Minnich & McKee

[57] ABSTRACT

A toroidal x-ray tube housing (A) has an evacuated interior. An annular anode (B) is connected with the housing closely adjacent the window such that a cooling fluid passage (12) is defined in intimate thermal communication with the anode. A cathode assembly (32) is mounted within the evacuated housing or an annular ring (30) that rotates an electron beam (22) around the large diameter annular anode. In the embodiment of FIGS. 1 and 2, the annular ring is magnetically levitated (40) and rotated by a motor (50). A collimator (62) and filter (64) are rotated with the cathode assembly closely adjacent an electron emitter or cathode cup (32) such that the generated x-rays are collimated and filtered within the x-ray tube. Preferably, a plurality of cathode cups (120) are provided, whose operation is selected by a series of magnetically controlled switches (76). The cathode cup is insulated (106) from the annular ring and isolated by a transformer (104, 112) from the filament current control switches. In the embodiment of FIGS. 4–6, the cathode assembly (C) includes a multiplicity of stationarily mounted electron cups (120) which are selectively actuated to rotate the electrode beam by a switch (130). An electron beam scan control (134) may bias the potential applied to grids (124, 126) to scan the electron beam generated by electron emitter over a commensurate arc length of the anode with the arc length of the emitter. In the embodiment of FIG. 7, multiple anode surface as well as multiple cathode cups are provided.

25 Claims, 6 Drawing Sheets

RING TUBE X-RAY SOURCE

This application is a continuation-in-part of U.S. patent application Ser. Nos. 07/817,294 pending 07/817,295 now U.S. Pat. No. 5,200,985 and 07/817,296; all filed on Jan. 6, 1992.

BACKGROUND OF THE INVENTION

The present invention pertains to the art of x or gamma ray generation. It finds particular application in conjunction with x-ray tubes for CT scanners and will be described with particular reference thereto. However, it is to be appreciated, that the present invention will find application in conjunction with the generation of x-rays for other applications.

Typically, a patient is positioned in a prone position on a horizontal couch through a central bore of a CT scanner. An x-ray tube is mounted on a rotatable gantry portion and rotated around the patient at a high rate of speed. For faster scans, the x-ray tube is rotated more quickly. However, rotating the x-ray more quickly decreases the net radiation per image. As CT scanners have become quicker, larger x-ray tubes which generate more radiation per unit time have been required, which, of course, cause high inertial forces.

High performance x-ray tubes for CT scanners and the like commonly include a stationary cathode and a rotating anode disk, both enclosed within an evacuated housing. As stronger x-ray beams are generated, there is more heating of the anode disk. In order to provide sufficient time for the anode disk to cool by radiating heat through the vacuum to surrounding fluids, x-ray tubes with progressively larger anode disks have been built.

The larger anode disk requires a larger x-ray tube which does not readily fit in the small confined space of an existing CT scanner gantry. Particularly in a fourth generation scanner, incorporating a larger x-ray tube and heavier duty support structure requires moving the radiation detectors to a larger diameter. This requires more detectors for the same resolution and provides a longer path length between the x-ray tube and the detectors. The longer path length can cause more radiation divergence and other degradation of the image data. Not only is a larger x-ray tube required, larger heat exchange structures are required to remove the larger amount of heat which is generated.

Rather than rotating a single x-ray tube around the subject, others have proposed using a switchable array of x-ray tubes, e.g. five or six x-ray tubes in a ring around the subject. However, unless the tubes rotate only limited data is generated and only limited image resolution is achieved. If the x-ray tubes rotate, similar mechanical problems are encountered trying to move all the tubes quickly.

Still others have proposed constructing an essentially bell-shaped, evacuated x-ray tube envelope with a mouth that is sufficiently large that the patient can be received in the well of the tube. An x-ray beam source is disposed at the apex of the bell to generate an electron beam which impinges on an anode ring at the mouth to the bell. Electronics are provided for scanning the x-ray beam around the evacuated bell-shaped envelope. One problem with this design is that it is only capable of scanning about 270°. Another problem is that the very large evacuated space required for containing the scanning electron beam is difficult to maintain in an evacuated state. Troublesome and complex vacuum pumping systems are required. Another problem is that no provision can be made for off-focus radiation. Another problem resides in its large physical size.

Messrs. Mayden, Shepp, and Cho in "A New Design For High-Speed Computerized Tomography", IEEE Transactions on Nuclear Science, Vol. NS-26, No. 2, Apr. 1979, proposed reducing the size of the conical or bell-shaped tube discussed above by rotating the cathode around the large diameter anode ring. However, their design had several engineering deficiencies and was never commercially produced.

The present invention contemplates a new and improved x-ray tube which can provide a tenfold or better power increase over currently available rotating anode x-ray tubes.

SUMMARY OF THE INVENTION

In accordance With one aspect of the present invention, a large diameter, tubular evacuated housing is provided. An anode target is disposed in the housing adjacent an annular window for directing x-rays toward a central axis of the annular housing. An electron source is disposed closely adjacent to the anode for generating an electron beam which travels a short distance from the electron source to the target anode. A means is provided for rotating the electron beam around the anode. A path is defined along and in intimate thermal communication with the anode for receiving a cooling fluid.

In one embodiment, the electron beam rotating means includes an annular cathode assembly that is mounted on a mechanical or magnetic bearing for rotation around the housing.

In other embodiments, the x-ray beam is adjustable. In one embodiment, a plurality of anodes are provided, each of a different diameter. At least one cathode filament or other controllable electron source is associated with each anode. In another embodiment, a window assembly is rotatable with the cathode assembly. A plurality of windows of different sizes are each associated with an electron source. In another embodiment, the anode face is movable.

In another embodiment, a stationary cathode is provided in an annular ring of substantially the same diameter as the target anode. A plurality of gating grids are provided for selectively gating only a small portion of the cathode to pass an electron beam to the target.

In accordance with a more limited aspect of the rotating cathode embodiment, the cathode assembly includes an annular ring which is magnetically levitated within the housing.

In accordance with another aspect of the present invention, the cathode ring assembly is driven by a brushless induction motor which has an annular stator outside of the housing and an annular rotor disposed inside of the housing.

In accordance with another aspect of the present invention, multiple cathode cups are provided. Each cathode cup includes a cathode filament or other electron emitter, and appropriate grids for focusing the generated electron beam. The multiple cathode cups each have a variety of preselected beam focus and other characteristics.

In accordance with another aspect of the invention, metal components of the rotor that are near the housing are insulated from the cathode cup and held near the potential of the housing.

In accordance with a more limited aspect of the invention, the cathode assembly is isolated from the rotor and from the filament current control circuitry by an isolation transformer. The isolation transformer permits switches and other components of the filament current control circuitry to operate at lower amperage and voltage.

In accordance with another aspect of the present invention, the annular housing includes an access panel to facilitate repair and replacement of burnt-out cathode cups.

In accordance with another aspect of the present invention, high voltage potential is communicated to the cathode assembly by a high voltage section that is connected to a stationary hot cathode that emits electrons. The cathode assembly includes an annular plate which is closely adjacent, and preferably partially surrounds, the hot cathode. One or more grids preferably surround the filament for grid control, mA regulation, and active filtering. The transfer of electrons between the hot cathode and the plate drives the cathode assembly to an x-ray tube operating voltage, generally on the order of 100 kV. Other hot filament, grid, and plate assemblies may be used to grid the cathode cup on and off.

In accordance with another aspect of the present invention, off-focal radiation reducers or filters are mounted on the rotating cathode assembly for rotation therewith.

In accordance with another more limited aspect of the present invention, a current coupling means is provided for communicating a cathode current from exterior to the envelope to the rotating cathode assembly. A plurality of magnetically controlled switches are mounted to the cathode assembly for selectively directing the received current to a selectable one of the cathodes or cathode grids. Annular electromagnets are disposed stationarily adjacent on the housing adjacent the path that the magnetically controlled switches follow as the cathode rotates. The electromagnet rings are selectively energized to open and close the switches and direct the current to the selected cathode or grid.

In accordance with a more limited aspect of the stationary cathode embodiment, the annular cathode includes a multiplicity of cathode segments. Each cathode segment is selectively gated to direct an electron beam at the anode.

In accordance with another more limited aspect of the present invention, grids are provided adjacent each cathode segment for gating the beam, focusing the beam, and sweeping or stepping the beam circumferentially around a segment of the anode.

One advantage of the present invention is that it increases the power over conventionally available 125 mm and 175 mm anode x-ray tubes.

Another advantage of the present invention is that it provides for efficient cooling of the anode.

Another advantage of the present invention is that it facilitates higher speed scans.

Another advantage of the present invention resides in its low bearing wear and long tube life.

Another advantage of the present invention is that the tube is field repairable.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENT

Figure 1:
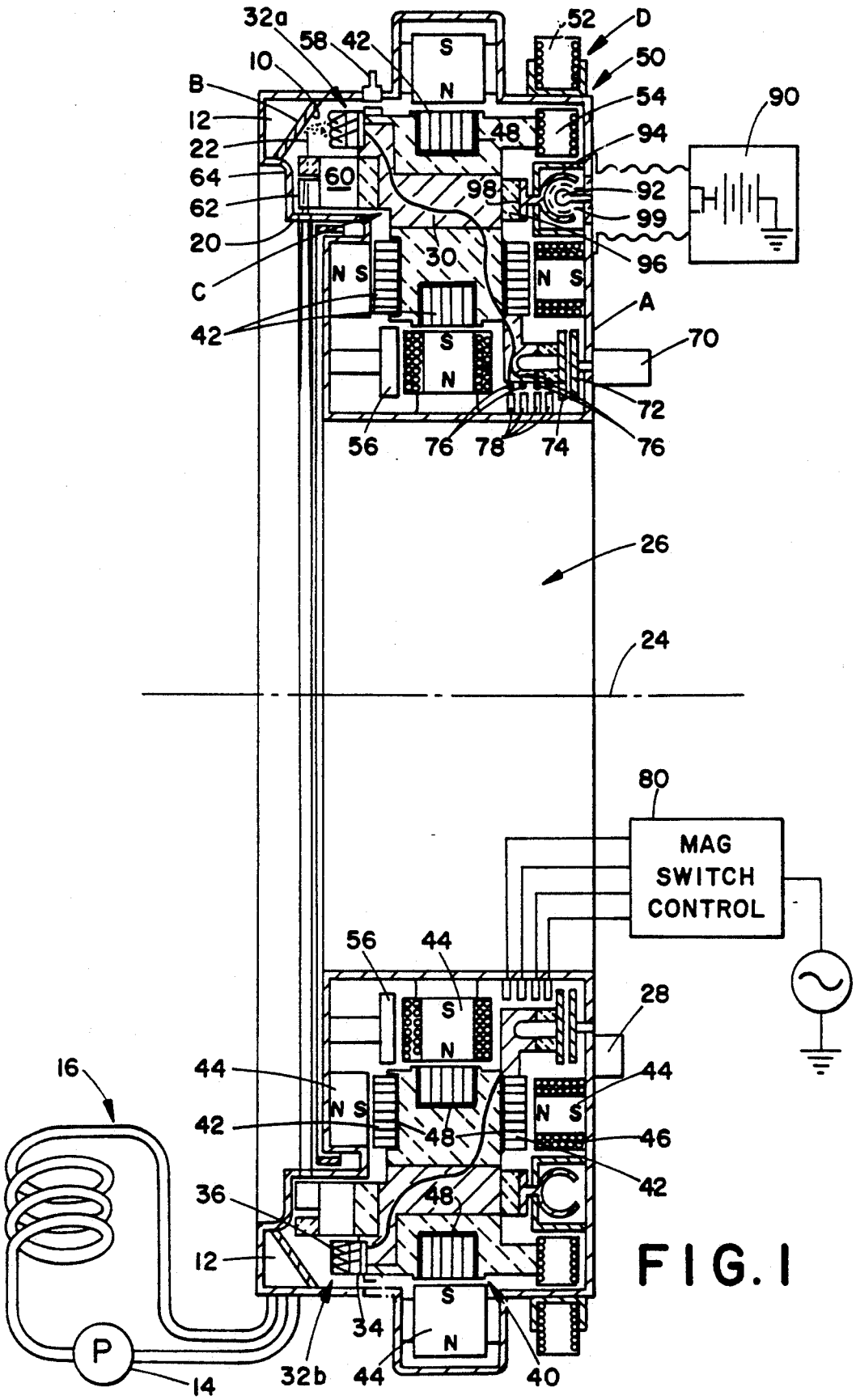
FIG. 1 is a cross-sectional view of a toroidal, rotating cathode x-ray tube in accordance with the present invention.
Figure 2:
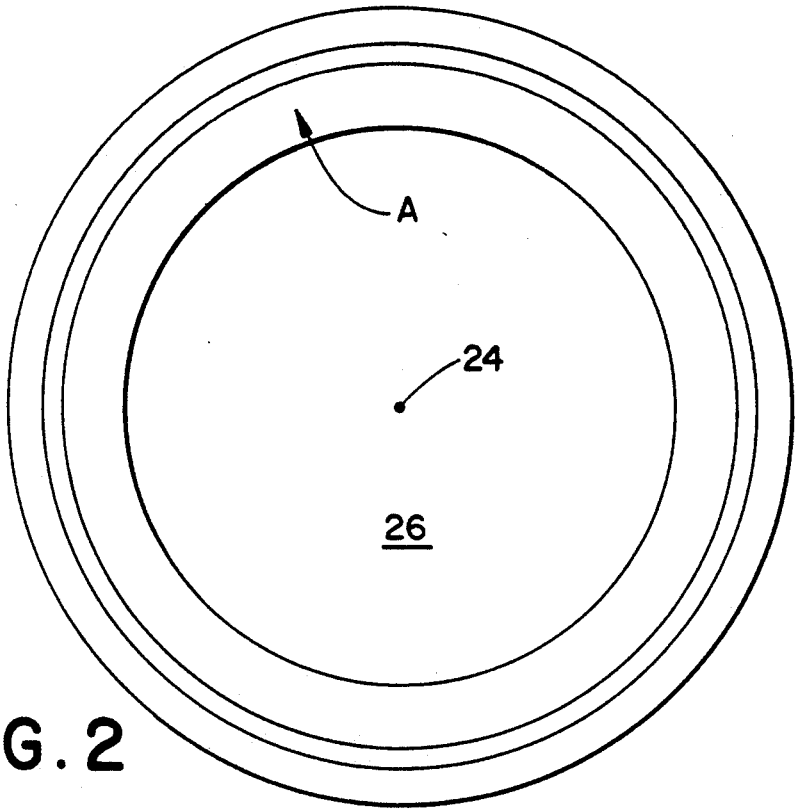
FIG. 2 is a front view of the x-ray tube of FIG. 1.

With reference to FIGS. 1 and 2, a toroidal housing A defines a large, generally donut-shaped interior volume. An anode B is mounted within the toroidal housing interior volume and extends circumferentially therearound. A rotor means c is disposed within the toroidal housing interior space for generating at least one beam of electrons. A means D selectively rotates the electron beam around the anode B.

More specifically, the anode B is a tungsten disk having a tungsten face 10 upon which the electron beam impinges. The housing and the anode define an annular cooling fluid path or channel 12 in intimate thermal communication with the anode face, specifically along an opposite surface of the anode. Optionally, the anode can have internal passages, fins, and the like to promote thermal communication with the cooling fluid. A fluid circulating means 14 circulates the fluid through the stationary anode and housing to a heat exchanger 16 to keep the target anode cool.

A window 20 is defined in the housing closely adjacent to the target anode B. The window is positioned such that x-rays 22 generated by interaction of the electron beam and the tungsten target anode are directed transverse to a central axis 24 of a central bore 26 of the toroidal tube. A vacuum means, preferably one or more ion pumps 28, is interconnected with the housing to maintain the vacuum within the housing.

In the embodiment of FIGS. 1 and 2, the cathode assembly includes an annular ring 30 which extends around the interior of the toroidal housing. A plurality of cathode cups including cups 32a and 32b are mounted on the cathode ring. The cathode cups 32 each include a cathode filament 34 and a grid assembly 36. Preferably, the grid assembly includes a grid for gating the electron beam on and off, a grid assembly for focusing the width of the electron beam in the radial direction, and a grid assembly for focusing the dimension of the electron beam in the circumferential direction.

In the preferred embodiment, each of the cathode cups 32 has a grid assembly with one of a variety of preselected focus characteristics. In this manner, different dimensions of the x-ray beam focal spot are chosen by selecting among the cathode cups. Optionally, there are multiple cathode cups focused with the most commonly used dimensions to provide a back-up cathode cup in the event the first cathode cup should burn out.

The cathode ring 30 is rotatably supported within the housing by a bearing means 40. In the preferred embodiment, the bearing means is a magnetic levitation bearing. Thin rings 42 of silicone iron or other material, suitably prepared to be insulating in vacuum, are longitudinally stacked to form cylinders for the radial portion of the bearing. Thin hoops of silicon iron or other material, also suitably prepared for use in vacuum, are assembled to form tightly nested cylinders for the axial portion of the bearing. Passive and active elements, i.e. permanent magnets 44 and electromagnets 46, are controlled by proximity sensors and suitable feedback circuits to balance attractive forces and suspend the cathode ring accurately in the center of the toroidal vacuum space and to center the cathode ring axially. Ceramic insulation 48 isolates the iron rings 42 from the cathode and any portions of the annular ring 30 that may be at the potential of the cathode. The isolation permits the iron rings to be held at the potential of the housing to prevent arcing between the rings 42 and the magnets 44, 46 and the housing.

A brushless, large diameter induction motor 50 includes a stator 52 stationarily mounted to the housing and a rotor 54 connected with the cathode ring. The motor causes the cathode assembly C to rotate at a selected speed through the toroidal vacuum of the housing. Mechanical roller bearings 56 are provided for supporting the cathode ring in the event the magnetic levitation system should fail. The mechanical roller bearings prevent the cathode ring from interacting with stationary housing and other structures. An angular position monitor 58 monitors the angular position of the cathode assembly, hence the angular location of an apex of the x-ray beam. The ceramic insulation 48 also isolates the rotor 54 and the angular position monitor from the potential of the cathode.

Adjacent each cathode cup assembly 32, there is a support 60 which rotates with the cathode cup. The support 60 carries an off-focal radiation limiting means or collimator 62, e.g. pairs of lead plates which limit length and width of the x-ray beam. Alternately, the off-focal radiation limiting means may include one or more apertured lead or tungsten-tantalum plates. A filter or compensator 64 is mounted to the support in or adjacent to the window for filtering the generated x-ray beams to provide beam hardness correction or the like. A preferred compensator material is beryllium oxide.

A current source 70 provides an AC current for actuating the selected cathode cup. The AC current is passed to a stationary, annular capacitor plate or inductive coil 72 mounted inside the housing. A matching, rotating capacitor plate or inductive coil 74 supported by the cathode ring is mounted closely adjacent to the stationary cathode plate. The rotating cathode plate or inductive coil is electrically connected with a series of magnetically controlled switches 76. Each of the switches 76 is connected with one of the cathode cups. A plurality of annular electromagnets 78 are stationarily mounted along the housing. An electrical control means 80 selectively actuates one or more of the electromagnets for selectively opening and closing the magnetically controlled switches to select among the cathode cups.

Alternately, external switches provide power to one of a plurality of stationary capacitor ring. Each of a matching plurality of rotating rings is connected with a different cathode cup. As yet another alternative, the capacitive coupling may be replaced by an inductive coupling, such as a stationary annular primary winding which is mounted closely adjacent and across an air gap from the rotating annular secondary winding.

The anode and the cathode are maintained at a high relative voltage differential, typically on the order of 100 kV. In the FIG. 1 embodiment, the stationary housing and the anode are held at ground, for user safety. The rotating cathodes are biased on the order of −100 to −200 kV relative to the housing. To this end, a high voltage section 90 generates a relatively high voltage which is applied to a hot cathode 92 of a vacuum diode assembly. Preferably, the high voltage supply is of a compact, high frequency type that is directly attached to the hot cathode to avoid the problems of high voltage cables and terminations. The hot cathode filament 92 is preferably of a low work function type. A circular channel of a toroidal or donut-shaped plate 94 partially surrounds the hot cathode filament 92. The toroidal plate is mounted to the cathode assembly for rotation therewith. Preferably, a ceramic or other thermally isolating plate or means 96 isolates the toroidal plate 94 from the rotating cathode. The current is conducted by a thin wire or metal film 98 from the toroidal plate to the remainder of the rotating cathode assembly to limit heat transfer. One or more grids 99 surround the hot filament 92 for grid control, mA regulation, and active filtering.

Figure 3:
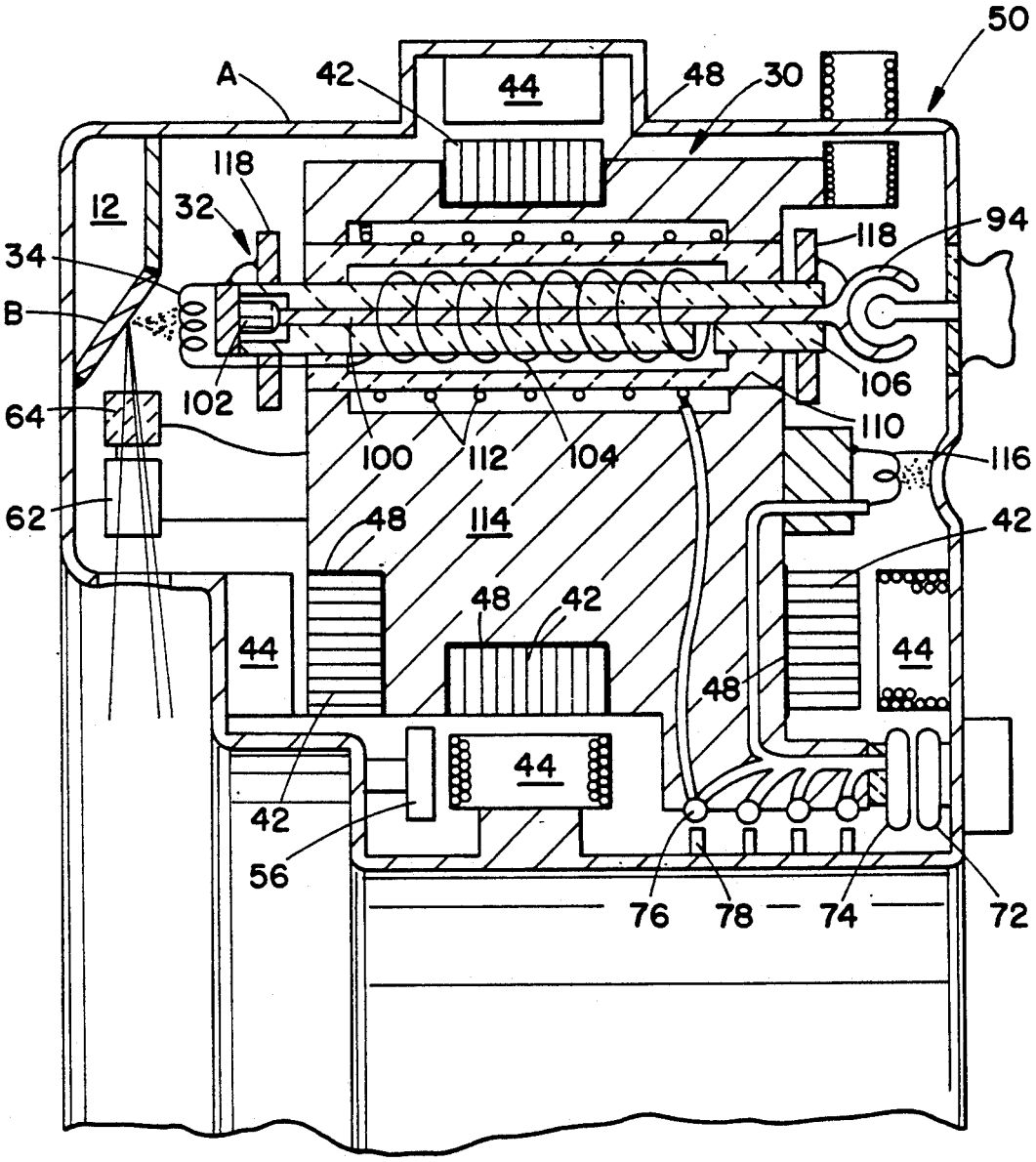
FIG. 3 is a detailed view of an embodiment in which the cathode is isolated from the rotating structure.

In the embodiment of FIG. 3, the cathode cups 32, which are held at a −100 to −200 kV relative to the housing A, is completely isolated from the remainder of the rotating annular ring 30 which is held at the same potential as the housing, preferably ground. More specifically, the toroidal ring 94 is connected by a metal strap loo with a bayonet or other quick connector 102. The cathode assembly has a mating connector which is received into the connector 102. In this manner, the cathode cup is held at the same potential as the toroidal ring 94. The filament 34 has one end connected with the cathode cup and the other end connected with the windings of a secondary coil 104. The secondary coil is wrapped around a tubular portion of a ceramic insulator 106 which insulates the conductive strap 100, the cathode cup, and the toroidal ring 94 from the remainder of the annular ring 30. The ceramic tube 106 in the voltage isolation transformer is preferably a ferrite material, due to its good magnetic flux transfer properties and electrical insulation properties.

A tubular insulating member 110 surrounds the secondary winding 104 to support a primary winding 112. In this manner, a voltage isolation transformer is constructed which isolates the voltage of the filament from the filament current control. One end of the primary winding is connected with a toroidal conductive portion 114 of the rotor C and the other end is connected with one of the reed switches 76. By selectively opening and closing the reed switch 76, power from the inductive or capacitive power transfer means 72, 74 is selectively conveyed to the primary. Preferably, the primary and secondary have different turns ratios such that the current flow is boosted by the isolation transformer.

The isolation transformer enables the reed switch 76 to operate at less than an amp, much lower than the 4–5 amps and possibly as high as 10 amps that are induced in the secondary 104 and cathode filament 34. Further, the isolation transformer allows the switches 76 to operate at only a few hundred volts AC, much lower than the −100 to −200 kV of the secondary 104.

It is to be appreciated, that even with the ceramic insulation tubes 106 and 110, the conductive portion 114 of the rotor will tend to become charged, eventually reaching the potential of the cathode. This is due in part to the finite resistance of the ceramic insulators. To create a potential equilibrium between the housing A and the conductive rotor portion 114, a filament 116 is connected between the power transfer means 72, 74 and the conductive portion 114, i.e. ground. This causes a current flow through the filament 116, causing electrons to be boiled off carrying any excess charge on the annular ring 30 to the housing. In this manner, the potential of the rotating portion is held at ground.

Flux shields 118, preferably a ferrite material, surround the cathode assembly 32 and the toroidal ring 94 to provide magnetic flux isolation. Alternately, the flux shields 118 may be constructed of a metallic, conductive material.

Figure 6:
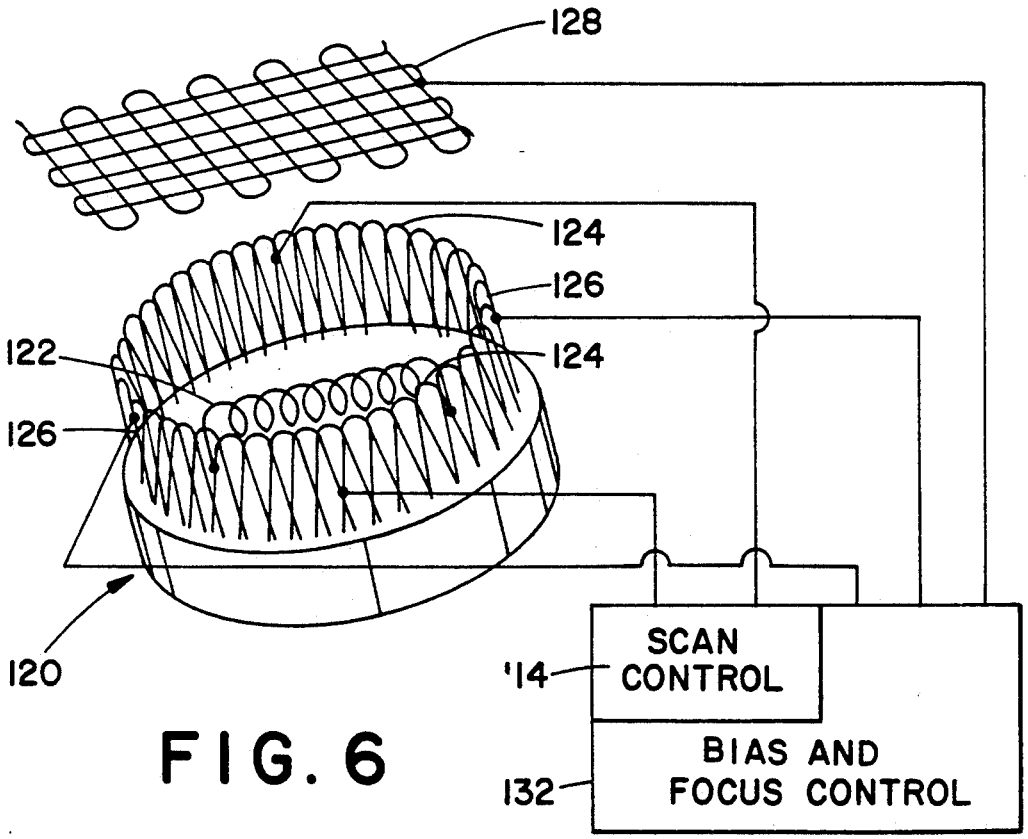
FIG. 6 is a perspective view of one of the cathode cups of FIGS. 4 and 5.
Figure 4:
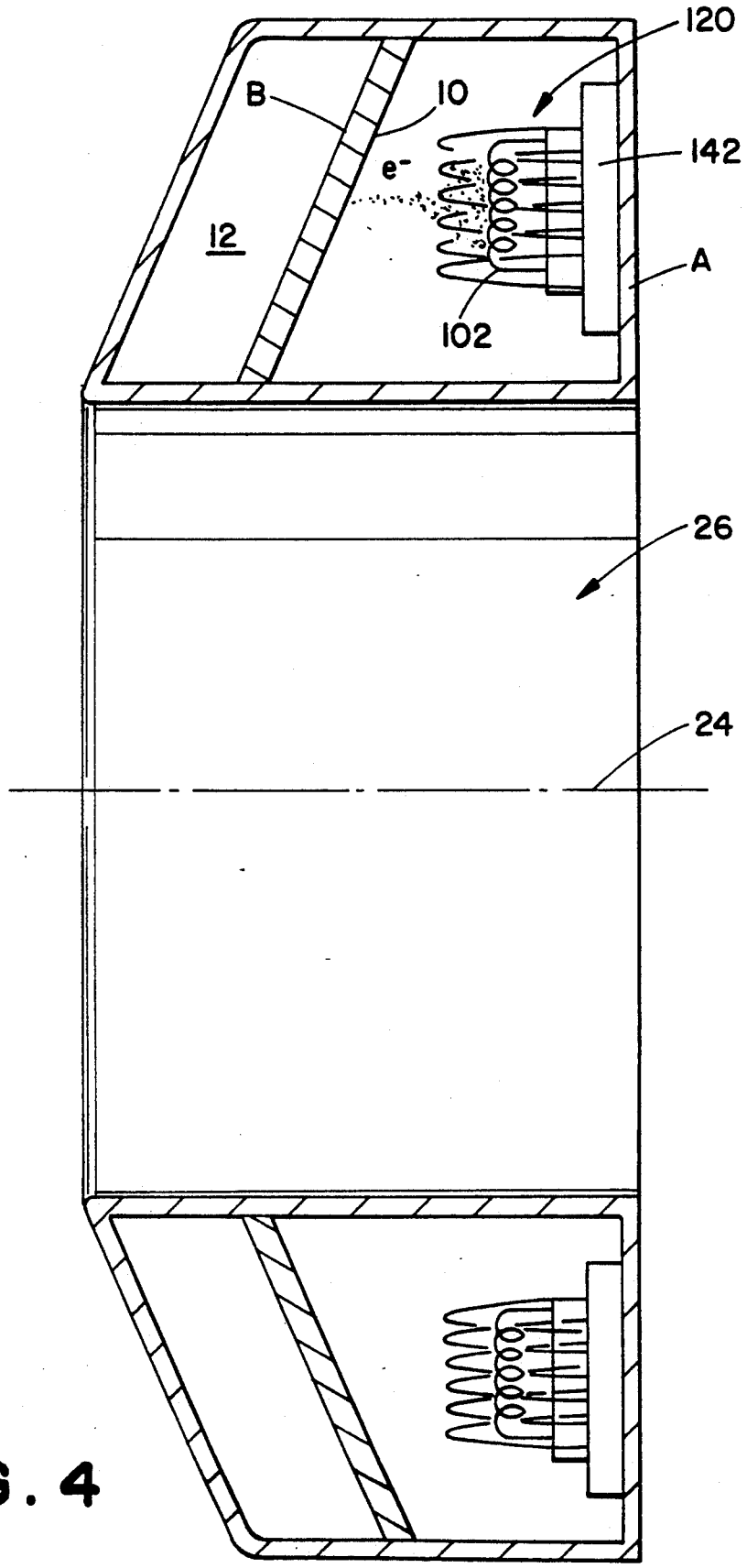
FIG. 4 is a transverse sectional view of an alternate embodiment of the toroidal x-ray tube of FIG. 1.
Figure 5:
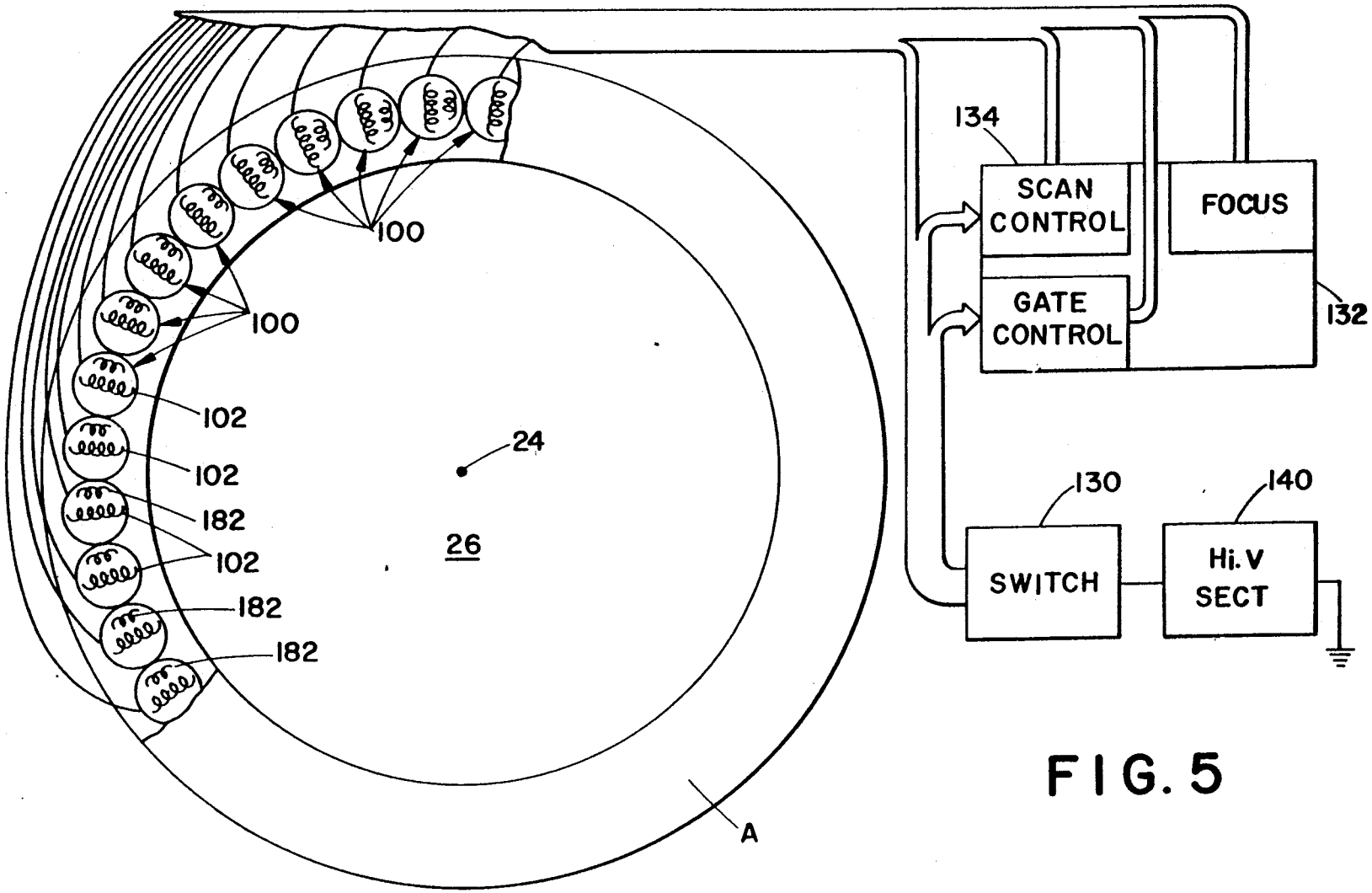
FIG. 5 is a front view in partial section of the tube of FIG. 4.

In the embodiment of FIGS. 4, 5, and 6, the housing A is again toroidal. The anode B is again annular and defines a cooling path 12 with a portion of the housing. The tungsten anode face lo is disposed toward the cathode assembly to generate the x-ray beam when excited by an electron beam from the cathode. The cathode assembly includes a multiplicity of cathode cups 12G arranged closely adjacent to each other in a ring around the housing Each cathode cup includes a cathode filament 122 which is heated by an excitation current to undergo thermionic emission. A grid assembly includes a pair of grids 124 for focusing the generated electron beam in a circumferential direction relative to the anode and a pair of grids 126 for focusing the electron beam in a radial direction. A gate electrode 128 selectively permits and prevents the electron beam from reaching the anode. In the preferred embodiment, a switching means 130 sequentially switches each of the gate grids 128 to permit the passage of electrons. In this manner, the electron beam is stepped, or moved in other selected patterns, around the anode.

A biasing and focusing control circuit 132 applies appropriate bias voltages to the grid pairs 124, 126 to focus the electron beam at a selected point on the anode relative to the cathode cup with a selected beam dimension. Optionally, the biasing and focusing circuit control 132 may include a scanning means 134 for gradually or incrementally shifting the bias voltage between the grids 124, 126 to sweep or scan the electron beam continuously or in a plurality of steps to a plurality of positions along an arc segment of the anode commensurate with a circumferential length of the cathode cup. Each time the switching means 130 switches to the next cathode cup, it causes the beam scanning means 134 to sweep the electron beam along each of its preselected circumferential beam positions.

A high voltage means 140 biases the cathode assembly C to a high voltage relative to the housing. A ceramic insulation layer 142 insulates the cathode cups from the housing such that the cathode cups can be maintained at a potential, on the order of −100 kV, relative to the housing. For operator safety, the housing is preferably held to ground and the cathode cups are biased on the order of −100 kV relative to the housing and the anode. Alternately, the anode may be electrically insulated from the housing and biased to a positive voltage relative to the housing. In such an embodiment, care must be taken that the cooling fluid is dielectric such that the cooling fluid does not short the anode to the housing.

The filaments of all the cathode cups are preferably driven concurrently. The switching means 130 further switches the high voltage supply 140 sequentially to each of the cathode cups 120. In this manner, only one or a small group of cathode cups at time is maintained at a sufficiently high voltage relative to the anode to cause an x-ray beam and the generation of x-rays. Of course, either the grid 128 or the individual cathode cup biasing (but not both) may be used to control the electron and x-ray beams.

Each individual cathode segment or cup preferably is constructed with radial slots with series or parallel connected filaments in each slot. Such slot and filament portions naturally provide line focus electron beams desirable for target loading when the grid voltage is removed from the desired segment. This radially slotted section may be divided in half and appropriately insulated to facilitate sweeping the focal spot across the anode track. These halves can also be used to alter the size of the focal spot.

An additional refinement may be obtained by heating the filament or, more generally the electron emitter by a second cathode structure behind the emitter and accelerated by a more modest potential and a locally controlled grid in a similar manner to the main cathode structure. One of the benefits achieved by this construction is that low temperature, low work function filaments may be employed. This lowers the heating current requirement substantially. The electron emitters can be heated very uniformly to achieve a very uniform focal spot. These emitters furthermore may be constructed of tungsten ribbon or other suitable shaped material of low effect thermal mass so that an emitter may be boosted to operating temperature very quickly, requiring only grid control of the second filament to achieve markedly lower heating energy to the electron emitter and a large increase in reliability.

Figure 7:
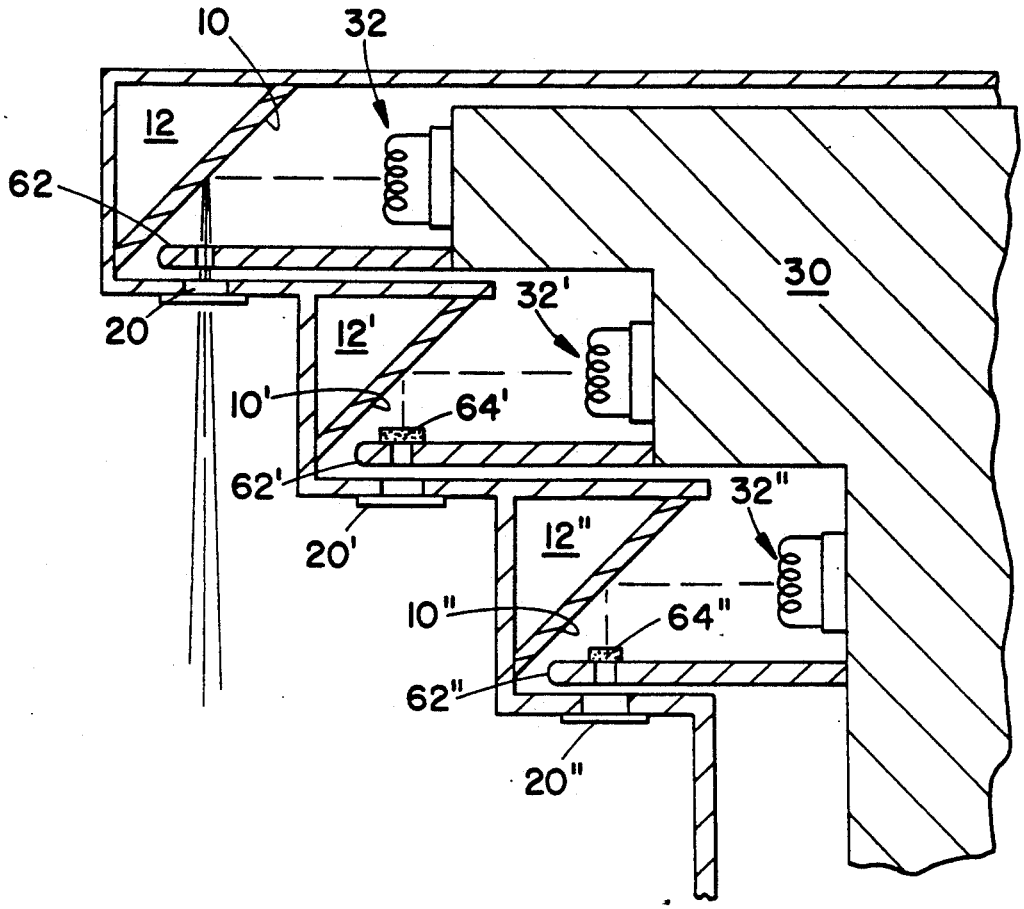
FIG. 7 is a sectional view of the anode/cathode cup portion of a multiple anode tube.

With reference to FIG. 7, multiple anodes 10, 10', and 10'' are mounted in stair/step fashion, each adjacent a corresponding window 20, 20', and 20''. A cathode cup 32, 32', and 32'' are mounted to the annular ring 30. Preferably, the annular ring 30 is rotatably mounted on magnetic bearings as described above. Alternately, multiple cathode cups can be positioned around the annular ring 30 as described in conjunction with FIGS. 3-5 above. Each cathode cup is controlled by the magnetic switch control so such that the operator can select among a plurality of modes of operation. For example, all three cathode cups can be operated simultaneously for multi-slice imaging. As another alternative, collimators 62, 62, and 62'' can be associated with each of the anode/cathode cup combinations. Each collimator can have a different aperture size to produce a different size or shape x-ray beam. As another alternative, each anode/cathode cup combination can have a different filter or compensator 64', 64'', associated with it.

Figure 8:
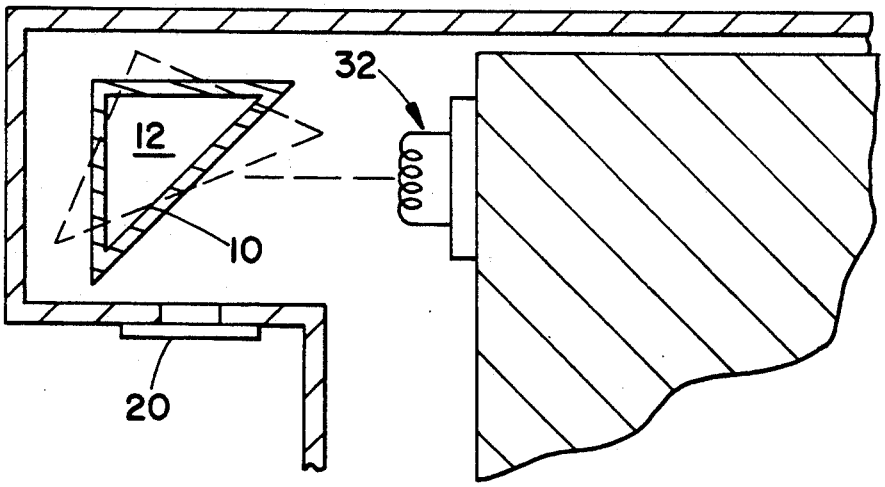
FIG. 8 is a sectional view of the anode/cathode cup portion of a movable anode tube.

With reference to FIG. 8, the anode assembly has a face 10 which is movable relative to the electron source 32. In the embodiment illustrated in FIG. 8, the anode surface along with the surrounding structure that defines the cooling fluid channel 12 is selectably rotatable or tippable as illustrated, to an exaggerated degree, in phantom. Instead of rotating, the surface may be flexed. Also, the anode surface may be other than a single plane such that shifting its position alters the characteristics of the anode surface which receives the electron beam.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. An x-ray generator comprising:

a generally toroidal housing having an evacuated interior;

an annular anode surface mounted in the toroidal housing interior, the anode surface being in thermal communication with a cooling fluid passage such that cooling fluid can be circulated contiguous to the anode surface for removing heat;

a cathode assembly including a multiplicity of cathode cups arranged in an annular ring within the housing opposite the anode surface, each of the cathode cups including an individual gate grid, a switching means for selectively biasing the gate grids to permit and prevent electron beams from flowing from the cathode cups to the anode, and a biasing means for selectively scanning an electron beam generated by each cathode cup along an arc segment of the anode surface.

2. The x-ray generator as set forth in claim 1 wherein each of the cathode cups is insulated from the housing and each other and wherein the switching means selectively switches a biasing potential between at least one selected cathode cups and the anode surface.

3. An x-ray generator comprising:

a generally toroidal housing having an evacuated interior;

an annular anode surface mounted in the toroidal housing interior, the anode surface being in thermal communication with a cooling fluid passage such that cooling fluid can be circulated contiguous to the anode surface for removing heat;

a cathode assembly including:

a cathode cup which holds a cathode filament which is heated by a current flowing therethrough to emit the electron beam;

the cathode cup being mounted to a first electrical insulator;

an annular ring on which the first insulator is supported;

a motor means for rotating the annular ring;

a means for magnetically levitating the annular ring within the toroidal housing;

one end of the cathode filament being connected with the cathode cup and the other end of the cathode filament being connected with a secondary winding extending around a portion of the first electrical insulator;

an electrical connector extending through the first electrical insulator from the cathode cup to a means which is biased to the cathode potential, the secondary winding being connected with the electrical connector;

a second electrical insulator surrounding the secondary winding; and a primary winding wound around the second electrical insulator, such that the primary winding is isolated from the secondary winding, the primary winding being connected with a means for controlling current flow through the cathode filament, whereby the means for controlling current flow through the cathode filament is isolated therefrom.

4. An x-ray generator comprising:

a generally toroidal housing having an evacuated interior and an annular x-ray permeable window;

an annular anode surface mounted in the toroidal housing interior, the anode surface being in thermal communication with a cooling fluid passage such that cooling fluid can be circulated contiguous to the anode surface for removing heat;

a cathode assembly rotatably received in the toroidal housing, the cathode assembly including:

an annular ring rotatably received in the toroidal housing evacuated interior, the annular ring having a smaller diameter surface toward a center of the toroidal housing, a larger diameter surface opposite to the smaller diameter surface, and a pair of oppositely disposed side edges, an active magnetic levitation bearing means including (i) annular permanent magnet rings mounted to the annular ring along each of the smaller diameter surface, the larger diameter surface, the pair of both side edges, (ii) a permanent magnet ring mounted to the toroidal housing adjacent the permanent magnet ring mounted to one of the larger and smaller diameter surfaces and the permanent magnets mounted to one of the side edges, and (iii) a first controllable electromagnetic ring stationarily mounted to the toroidal housing adjacent the permanent magnet mounted to the other of the larger and smaller diameter surfaces and a second controllable electromagnetic ring mounted to the toroidal housing adjacent the permanent magnet ring mounted to the other side edge, at least one electron beam generating means mounted to the annular ring for rotation therewith;

a means for transferring a filament current from a filament current source exterior to the toroidal housing to the electron beam generating means mounted to the rotatable annular ring in the toroidal housing;

a large diameter induction motor having a stator mounted to the toroidal housing and a rotor connected with the annular ring for rotating the annular ring and the electron beam generating means within the toroidal housing.

5. The x-ray generator as set forth in claim 4 further including a mechanical bearing means for supporting the annular ring in the event of a failure magnetic levitation bearing means.

6. An x-ray generator comprising:

a generally toroidal housing having an evacuated interior;

an annular anode surface mounted in the toroidal housing interior, the anode surface being in thermal communication with a cooling fluid passage such that cooling fluid can be circulated contiguous to the anode surface for removing heat;

a cathode assembly mounted on an annular surface disposed within the toroidal housing including a means for emitting electrons to form an electron beam that strikes the anode surface;

an annular rotating capacitor plate mounted to the annular ring in a capacitively coupled relationship to a stationary capacitor plate mounted to the housing, the rotating capacitor plate being connected with the electron emitting means for controlling electrical power thereto and the stationary cathode plate being connected with an AC power source;

a means for moving the electron beam to at least a multiplicity of points around the anode surface.

7. An x-ray generator comprising:

a generally toroidal housing having an evacuated interior and an annular x-ray permeable window facing a central axis of the toroidal housing;

an annular anode surface mounted in the toroidal housing interior, the anode surface being in thermal communication with a cooling fluid passage such that cooling fluid can be circulated contiguous to the anode surface for removing heat;

a cathode assembly including;

an annular ring rotatably disposed within the evacuated interior of the toroidal housing and centered around the central axis, a means for emitting electrons in the form of an electron beam that strikes the anode surface, the electron emitting means being mounted to the annular ring, an annular secondary transformer winding mounted to the annular ring and centered around the central axis, the annular secondary transformer winding being connected with the electron emitting means for providing a filament current thereto;

an annular primary transformer winding mounted to the toroidal housing adjacent the annular secondary transformer winding such that electrical current is selectively transferred therebetween;

a means for rotating the annular ring within the evacuated interior of the toroidal housing.

8. An x-ray generator comprising:

a generally toroidal housing having an evacuated interior;

an annular anode surface mounted in the toroidal housing interior, the anode surface being in thermal communication with a cooling fluid passage such that cooling fluid can be circulated contiguous to the anode surface for removing heat;

a cathode assembly mounted on an annular ring rotatably disposed within the toroidal housing including:

a means for emitting electrons to form an electron beam that strikes the anode surface, a supporting means mounted to the annular ring adjacent the electron emitting means, the supporting means supporting at least one of an off-focal radiation collimator means and a filter means for filtering the x-ray beam, the supporting means supporting the collimator means and the filter means closely adjacent the anode means such that the filter means and the collimating means rotate with the electron beam;

a means for rotating the annular ring such that the electron beam rotates to at least a multiplicity of points around the anode surface.

9. An x-ray generator comprising:

a generally toroidal housing constructed primarily of metal, the housing having an evacuated interior;

an annular metal anode surface mounted in the toroidal housing interior in electrical communication therewith such that the anode surface and the toroidal housing are in substantial electrical potential equilibrium with each other, the anode surface being in thermal communication with a cooling fluid passage such that the cooling fluid can be circulated contiguous to the anode surface for removing heat;

a cathode assembly rotatably received in the evacuated interior of the toroidal housing, the cathode assembly including a cathode cup which emits electrons to form an electron beam that strikes the anode surface in response to receiving a filament current;

a means for establishing a large potential difference between the cathode cup and the anode surface;

an isolation transformer mounted to the cathode assembly, the isolation transformer including a secondary winding connected with the cathode cup and maintained substantially at the potential thereof and a primary winding which is maintained substantially at the potential of the housing, the primary winding being connected with a means for transferring heating current from the toroidal housing to the rotating cathode assembly;

a means for rotating the cathode assembly within the evacuated interior of the generally toroidal housing.

10. The x-ray generator as set forth in claim 9 wherein the cathode assembly includes an annular ring, at least a portion of which is conductive, the electrically conductive portion of the annular ring being electrically isolated from the electron emitting means and further including a means for holding the conductive annular ring portion at the same potential as the housing.

11. The x-ray generator as set forth in claim 10 wherein the means for holding the conductive annular ring portion at the same potential as the housing includes a filament which is heated to boil off electrons which are conducted to the housing.

12. An x-ray tube comprising:

a generally toroidal housing having an evacuated interior;

an annular anode surface mounted in the toroidal housing interior, the anode surface being in thermal communication with a cooling fluid passage such that cooling fluid can be circulated contiguous to the anode surface for removing heat;

a cathode assembly including:

an annular ring rotatably disposed within the toroidal housing, a plurality of electron emitting means for emitting electrons to form an electron beam that strikes the anode surface, the electron emitting means being supported by the annular ring;

a coupling means for selectively coupling the electron emitting means with an exterior current supply; and, a switching means supported by the annular ring for selectively switching supplied current among the electron emitting means;

a means for rotating the annular ring.

13. The x-ray tube as set forth in claim 12 wherein the switching means includes a plurality of magnetically controlled switches which are mounted for rotation with the annular ring and a plurality of annular electromagnets mounted to the housing, each annular electrode magnet being disposed closely adjacent to a path of rotation of one of the magnetically controlled switches for selectively supplying a controlling magnetic field thereto.

14. An x-ray generator comprising:

a generally toroidal housing constructed primarily of metal, the housing having an evacuated interior;

an annular metal anode surface mounted in the toroidal housing interior in electrical communication therewith such that the anode surface and the toroidal housing are in substantial electrical potential equilibrium with each other, the anode surface being in thermal communication with a cooling fluid passage such that the cooling fluid can be circulated contiguous to the anode surface for removing heat;

a cathode assembly including:

an annular ring rotatably received in the evacuated interior of the toroidal housing, the rotatable ring including an electrically conductive portion and an electrically insulating portion, a cathode cup means for emitting electrons to form an electron beam that strikes the anode surface, the cathode cup means being mounted to the electrically conductive portion of the annular ring such that the electrically conductive portion and the cathode cup means are substantially in electrical potential equilibrium, a magnetic levitation bearing means mounted to the electrically insulating portion of the annular ring and to the toroidal housing such that the magnetic levitation bearing means and the toroidal housing are maintained substantially in electrical equilibrium with each other;

a means for maintaining a large electrical potential difference between the cathode cup and the toroidal housing;

a means for rotating the annular ring within the evacuated interior of the toroidal housing.

15. An x-ray generator comprising:

a generally toroidal housing having an evacuated interior;

an annular anode surface mounted in the toroidal housing interior, the anode surface being in thermal communication with a cooling fluid passage such that cooling fluid can be circulated contiguous to the anode surface for removing heat;

a cathode assembly including:

an annular ring rotatably received in the evacuated interior of the housing;

a means for emitting electrons to form an electron beam that strikes the anode surface the electron emitting means being mounted to the annular ring;

a high voltage biasing means for biasing the cathode assembly to a high negative voltage relative to the housing, the high voltage biasing means including at least one hot cathode supported by the housing and a partially toroidal electron receiving plate at least partially encompassing the hot cathode and supported by the annular ring such that the toroidal plate remains closely adjacent to the hot cathode as the annular ring rotates;

a means for rotating the annular ring around the evacuated interior of the housing.

16. The x-ray generator as set forth in claim 15 further including a grid between the hot cathode and the receiving plate.

17. The x-ray generator as set forth in claim 15 wherein the high voltage biasing means includes a means which is biased to the high voltage, the high voltage biased means being electrically connected with the cathode assembly; and further including an electrical insulation means for insulating the high voltage biased means, the cathode, and an electrical connection therebetween from other portions of the annular ring.

18. The x-ray generator as set forth in claim 17 wherein the cathode assembly includes a cathode cup and further including a quick connect coupling for electrically and mechanically connecting the cathode cup and the electrical connection.

19. The x-ray generator as set forth in claim 17 further including:

a secondary winding extending around at least a portion of the insulation means, the secondary winding being connected at one end with the electrical connection, and at its other end with the cathode assembly;

a second electrical insulation means surrounding the secondary winding;

a primary winding surrounding the second insulation means which surrounds the secondary winding, whereby an electrical isolation transformer is defined.

20. The x-ray generator as set forth in claim 19 wherein the primary winding is connected with a means for controlling current flow through the cathode assembly.

21. An x-ray tube comprising:

a generally toroidal housing having an evacuated interior;

an annular anode surface mounted in the toroidal housing interior, the anode surface being in thermal communication with a cooling fluid passage such that cooling fluid can be circulated contiguous to the anode surface for removing heat;

a cathode assembly disposed within the toroidal housing including:

an annular ring rotatably disposed within the housing, a means for emitting electrons to form an electron beam that strikes the anode surface;

a means for rotating the annular ring within the toroidal housing;

a position encoder for providing an encoded signal indicative of an angular position of the annular ring relative to the housing.

22. An x-ray tube comprising:

a generally toroidal housing having an evacuated interior;

an annular anode surface mounted in the toroidal housing interior, the anode surface being in thermal communication with a cooling fluid passage such that cooling fluid can be circulated contiguous to the anode surface for removing heat;

a cathode assembly including;

a means for emitting electrons to form an electron beam that strikes the anode surface, the electron emitting means rotatably disposed within the toroidal housing, a means for supporting at least one of a collimator and a filter mounted adjacent the electron emitting means for rotation therewith;

a means for rotating the electron emitting means within the toroidal housing.

23. An x-ray tube comprising:

a generally toroidal housing having an evacuated interior;

a first annular anode surface mounted in the toroidal housing interior, the first anode surface being in thermal communication with a first cooling fluid passage such that cooling fluid can be circulated contiguous to the first anode surface for removing heat;

a second anode surface mounted in the toroidal housing interior in thermal communication with a second cooling fluid passage;

a cathode assembly disposed within the toroidal housing including:

a first means for emitting electrons to form a first electron beam that strikes the first anode surface;

a second means for emitting electrons mounted on the cathode assembly for selectively forming a second electron beam which strikes the second anode surface;

a means for moving the first and second electron beams to a multiplicity of points around the first and second anode surfaces.

24. The X-ray tube as set forth in claim 23 wherein the first and second anode surfaces are concentric circular annuli of different radius.

25. The x-ray tube as set forth in claim 23 further including:

a first filter and collimator assembly mounted to the cathode assembly and disposed adjacent the first anode surface;

a second filter and collimator assembly mounted to the cathode assembly adjacent the second anode surface.

* * * * *

UNITED STATES PATENT AND TRADEMARK OFFICE

CERTIFICATE OF CORRECTION

PATENT NO. : 5,268,955

DATED : December 7, 1993

INVENTOR(S) : Burke et al.

It is certified that error appears in the above-identified patent and that said Letters Patent is hereby corrected as shown below:

On the cover sheet, the filing date of the application in section 22 should read --April 3, 1992--.

Signed and Sealed this

Thirty-first Day of May, 1994

Bruce Lehman

*Attest:*

BRUCE LEHMAN

*Attesting Officer*

*Commissioner of Patents and Trademarks*